United States Patent [19]

Murphy

[11] 4,443,200

[45] Apr. 17, 1984

[54] TOILET TRAINING DEVICE

[76] Inventor: Judith K. Murphy, 58 Norwood Ave., Albany, N.Y. 12208

[21] Appl. No.: 521,093

[22] Filed: Aug. 8, 1983

[51] Int. Cl.[3] ..... G09B 19/00

[52] U.S. Cl. ..... 434/247; 46/141; 434/268

[58] Field of Search ..... 434/247, 262, 267, 268, 434/272; 46/116, 141

[56] References Cited

U.S. PATENT DOCUMENTS 2,213,270 9/1940 Chase ..... 434/268
3,775,901 12/1973 Ellman et al. ..... 46/141 X

FOREIGN PATENT DOCUMENTS 2216008 10/1973 Fed. Rep. of Germany ..... 46/116
380960 9/1932 United Kingdom ..... 46/141
1258323 12/1971 United Kingdom ..... 46/116

*Primary Examiner*—William H. Grieb
*Attorney, Agent, or Firm*—Walter F. Wessendorf, Jr.

[57] ABSTRACT

Disclosed is a toilet training device for toilet training of children, embodied as an animal, such as a bear, having a lower torso having anterior and posterior chambers with upper access ports for filling the anterior chamber with water and the posterior chamber with soft material. Upon sufficient pressure being applied to the anterior chamber, a lower valve opens to allow the water to pass therethrough representing urine; and upon sufficient pressure being applied to the posterior chamber, a lower valve opens to allow such soft material to pass therethrough representing stools.

3 Claims, 4 Drawing Figures

TOILET TRAINING DEVICE

BACKGROUND OF THE INVENTION

1. Technical Field

This invention relates to a toilet training device by means of which a child may be assisted in his toilet training.

2. Background

In the field of early childhood education and special education, there is a need for a toilet training device which will assist parents, educators and others in the toilet training of children.

Modeling

One method which is used in teaching children is termed modeling. Modeling is essentially the process of showing a child how to do something by having him or her observe a "model" to do it. Whenever a child learns new behavioral responses as a result of watching a model emit that reponse, the modeling effect has occurred.

The toilet training device employed in this invention is any animal which duplicates the human function of eliminating urine and stools. This elimination by the animal is performed in a sanitary and disposable manner so that the child is able to witness appropriate toileting procedures.

The animal itself is asexual. That is, there are not identifiable characteristics which are male or female. A specific example of the educational device employed is a bear.

Tap water is appropriately inserted or injected into an anterior chamber of the bear through an access port in such anterior chamber; and soft material is appropriately inserted or injected into a posterior chamber of such bear through an access port in such posterior chamber.

The animal may then be appropriately manipulated by the toilet trainer (parent, educator, or other person) either to cause the water to pass from such anterior chamber through a lower valve into a training potty to represent the elimination of urine, or to cause the soft material to pass from such posterior chamber through a lower valve into such training potty to represent the elimination of stools.

The animal is a symbolic model which children imitate in order to learn appropriate toileting responses. Behavior can and is learned through observation. While the toilet trainer shows the child how the animal or bear "goes into the bear toilet", such child observes the process and listens to the trainer's words. During this presentation, symbolic mediational processes occur within the child whereby the child incorporates visual images and verbal mediators into his or her thought patterns. These symbolic processes assist the child in learning new toileting skills.

Play

Another method whereby the toilet training device can be used is through play. The child is asked to help the bear to "poop and pee into the toilet". The trainer assists the child in appropriately manipulating the bear. The element of play in toilet training has the potential for significantly reducing anxiety in the child and parents. This reduction in anxiety therefore indirectly lowers stress levels in the lives of young children and primary caregivers during a time when toilet training is a crucial developmental task to be mastered.

PREVENTION OF CHILD ABUSE

The United States Department of Health and Human Services issued a report in 1981 on the severity and incidence of child abuse and neglect in the United States. The report maintained that 74 percent of fatalities occurred in the age group from birth to six. Forty-nine percent of deaths happened to children from birth to two. Toilet training generally occurs around the age of two years.

It is hypothesized that this toilet training device, by assisting parents in the toilet training process, could reduce stress and therefore prevent a potentially abusive situation.

Abusive behavior is incompatible with teaching or playing behavior. Consequently, when a caregiver is busy showing the appropriate toileting procedure to a child, there is no room for abusive behavior to occur. Furthermore, successful attainment of the toileting task by the child eliminates the caregiver's diaper changing responsibilities and ultimately increases the child's self esteem.

Accordingly, the object of the invention is to contribute to the solution of toilet training of children by providing a toilet training device embodied in the form of a bear or other animal whose lower torso has an anterior chamber and a posterior chamber. The anterior chamber has an upper access port into which water can be inserted or injected and a lower valve from which such water representing urine can be eliminated. The posterior chamber has an upper access port into which suitable soft material of the type commonly referred to as "play dough" can be inserted or injected and a lower valve from which such soft material representing stools can be eliminated.

SUMMARY OF THE INVENTION

In accordance with the invention, there is provided a toy animal whose lower torso has an anterior chamber and a posterior chamber. The anterior chamber has an upper access port through which water can be inserted or injected to fill such anterior chamber, and a lower valve through which such water representing urine can be eliminated from such anterior chamber. Appropriate and sufficient manipulative pressure is applied upon the anterior chamber to result in sufficient interior pressure build-up within such anterior chamber to cause the lower valve to open to allow water representing urine to pass therethrough from the anterior chamber. The pressure applied to such anterior chamber is similar to the pressure experienced in human urination. The posterior chamber has an upper access port through which suitable soft material can be inserted or injected to fill such posterior chamber, and a lower valve through which such soft material representing stools can be eliminated from such posterior chamber. Appropriate and sufficient manipulative pressure is applied in the manner of squeezing pressure by both hands upon such posterior chamber in the buttocks region of the animal to result in sufficient interior pressure build-up within such posterior chamber to cause the lower valve to open to allow such soft material to pass therethrough from such posterior chamber. The squeezing pressure applied to such posterior chamber is similar to the pressure experienced in human defecation.

BRIEF DESCRIPTION OF THE DRAWINGS

This object and other objects of the invention should be discerned and appreciated by reference to the drawings, wherein like reference numerals refer to similar parts throughout the several views, in which.

DESCRIPTION OF THE PREFERRED EMBODIMENT

Figure 1:
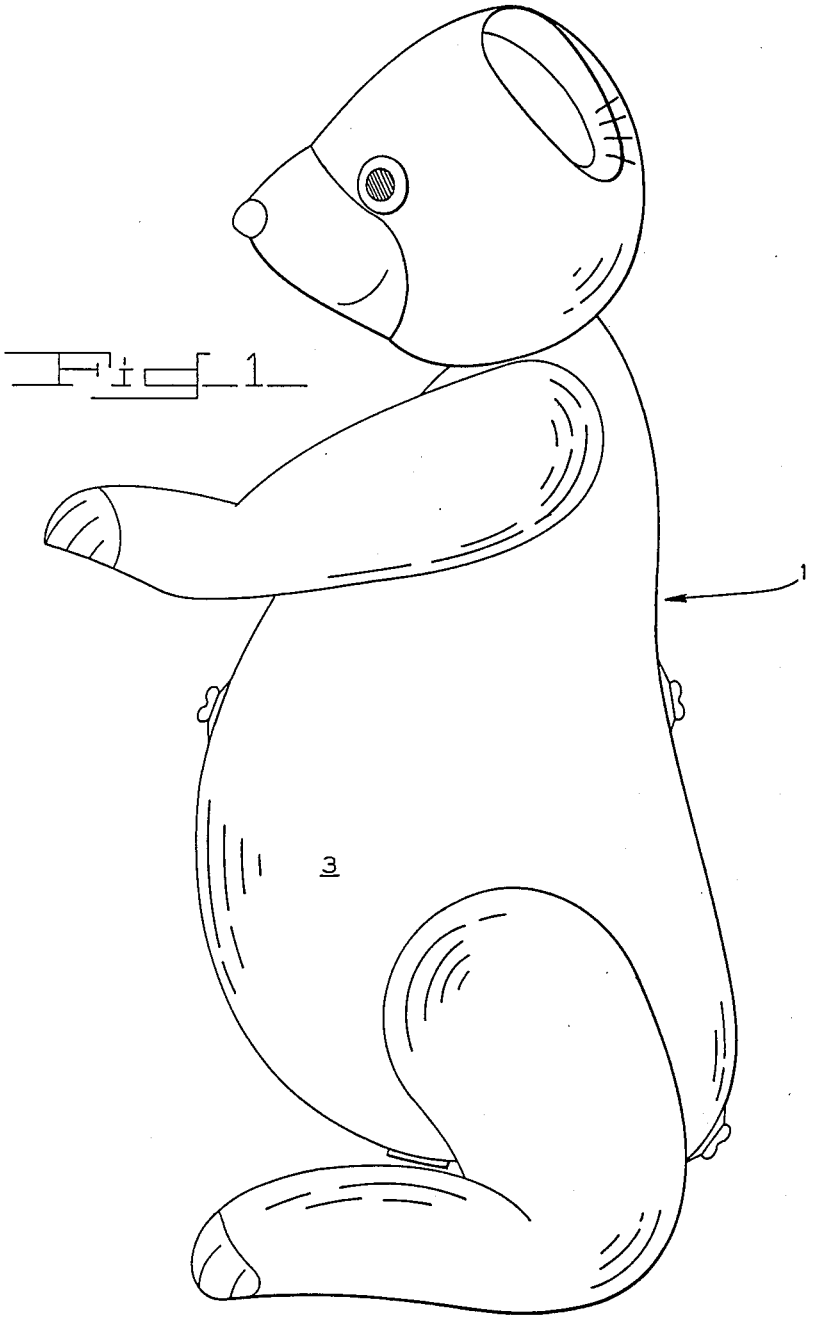
FIG. 1 is a side elevational view of the invention.
Figure 3:
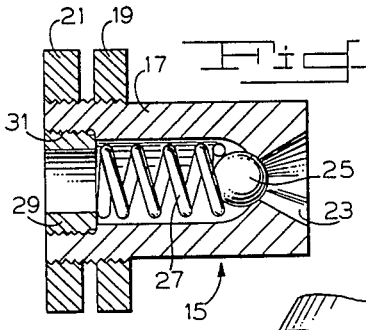
FIG. 3 is a sectional view of the lower valve of the anterior chamber.
Figure 4:
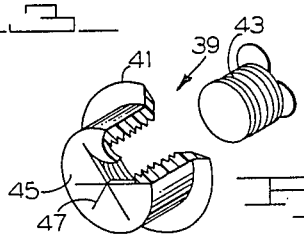
FIG. 4 is a perspective view of the lower valve of the posterior chamber.
Figure 2:
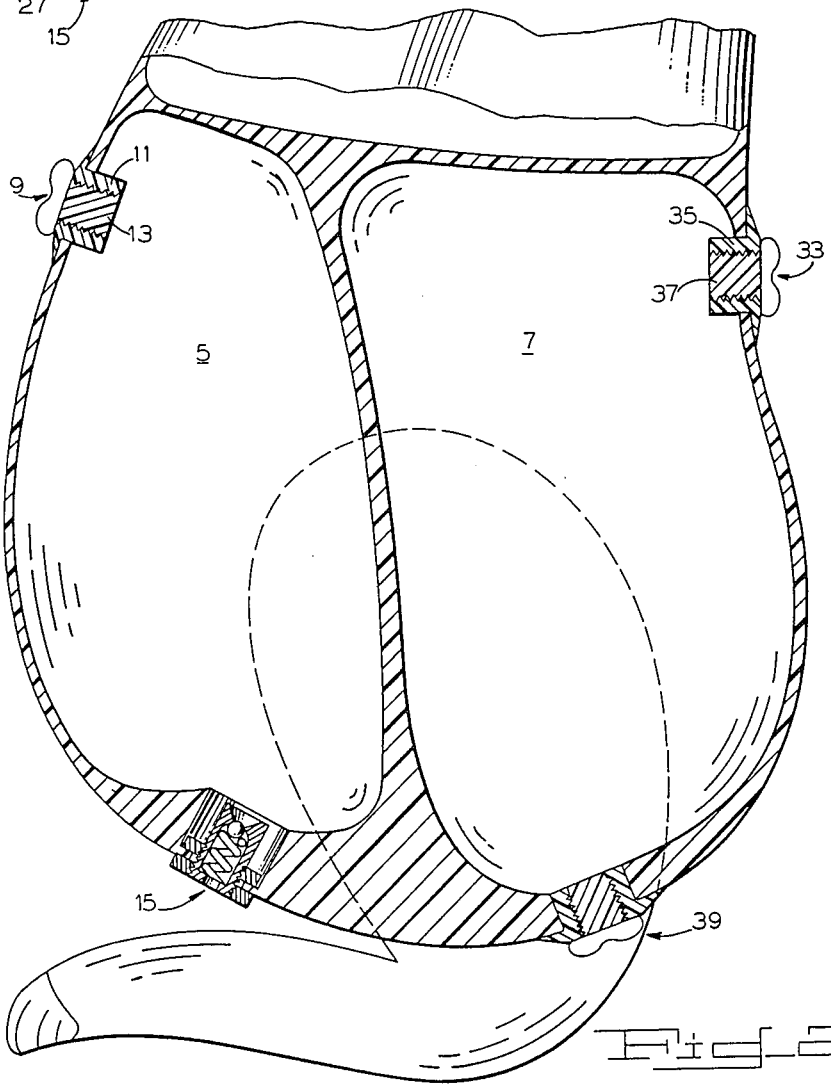
FIG. 2 is a sectional view of the lower torso of the invention.

In FIG. 1 of the drawings, reference numeral 1 generally refers to the toilet training device, embodied as a bear, of suitable plastic material and whose lower torso 3 has a waterproof anterior chamber 5 separated from a waterproof posterior chamber 7, as shown.

Anterior chamber 5 fixedly carries an upper access port 9 whose tapped port body 11 is removably engaged by a threaded plug 13. Threaded plug 13 is replaced after water is inserted or injected through port body 11 to fill the anterior chamber 5.

A lower valve 15 is affixed to anterior chamber 5, as shown, by means of an externally threaded valve body 17 engaged by two flange nuts 19 and 21 between which are fixedly mounted plastic material of the anterior chamber 5. Valve body 17 has a valve port 23 closed by a ball 25 engaged therewith and biased into such closed engagement by a compression spring 27 interposed between such ball 25 and a threaded spacer element 29 engaged with a tapped hole 31 formed in valve body 17.

Appropriate and sufficient manipulative pressure applied upon the anterior chamber 5 results in sufficient interior pressure build-up of the water within such anterior chamber 5 to cause the lower valve 15 to open to allow water representing urine to pass therethrough from the anterior chamber 5. Lower valve 15 opens upon sufficient force being transmitted from such water pressure build-up to move ball 25 away from its valve seat in valve port 23 and against the biasing and restoring force of compression spring 27. When manipulative pressure is no longer applied to anterior chamber 5 or when the applied manipulative pressure is no longer sufficient to overcome the restoring force of compression spring 27, ball 25 will be reseated in its valve seat in valve port 23 to thereby seal the anterior chamber 5.

Posterior chamber 7 fixedly carries an upper access port 33 whose tapped port body 35 is removably engaged by a threaded plug 37. Threaded plug 37 is replaced after suitable soft material is inserted or injected through port body 35 to fill posterior chamber 7.

Posterior chamber 7 fixedly carries a lower valve 39. Valve 39 has a tapped valve body 41 that is removably engaged by a threaded plug 43. Valve body 41 is closed on its end by a flexible membrane 45 having slits 47 therethrough.

After the posterior chamber 7 has been filled with such suitable soft material, the threaded plug 43 is removed from valve body 41. The radial slits 47 in flexible membrane 45 function and operate to close valve 39 when no pressure is applied to posterior chamber 7 or when the pressure being applied to posterior chamber 7 is insufficient. Appropriate and sufficient pressure applied in the manner of squeezing pressure by both hands upon posterior chamber 7 in the buttocks region will cause some of the soft material to be eliminated through and exteriorly of the slits 47 in flexible membrane 45 by such radial slits 47 spreading open. When posterior chamber 7 is relieved of such pressure, the radial slits 47 will close together.

Hence, upon sufficient squeezing pressure being applied to posterior chamber 7 followed by relief from such pressure, a stool of such soft material will be passed through the radial slits 47.

Having thusly described my invention, I claim:

1. A toilet training device for toilet training of children, said toilet training device having an anterior chamber and a posterior chamber, said anterior chamber holding water and said posterior chamber hold soft material, said anterior chamber having an upper access port for filling said anterior chamber with water, said posterior chamber having an access port for filling said posterior chamber with such soft material, each of said upper access ports comprising a tapped port body and a threaded plug with said threaded plug being removably engaged with said tapped port body, said chamber having means to allow such water representing urine to pass from said anterior chamber upon sufficient pressure being applied to said anterior chamber holding such water, said posterior chamber having means to allow such soft material representing stools to pass from said posterior chamber upon sufficient pressure being applied to said posterior chamber, said means to allow such water representing urine to pass from said anterior chamber upon sufficient pressure being applied to said anterior chamber holding such water comprising a lower valve, said lower valve comprising a valve port, ball and compression spring, said spring biasing said ball into seating relationship with said valve port to close said valve, and said valve opening to allow water to pass therethrough by said ball moving away from said valve port against the biasing force of said spring upon sufficient pressure being applied to said anterior chamber.

2. A toilet training device in accordance with claim 1, wherein said means to allow such soft material representing stools to pass from said posterior chamber upon sufficient pressure being applied to said posterior chamber holding such soft material comprises a lower valve, wherein said lower valve comprises a valve body and flexible membrane, said valve body defining said flexible membrane and said membrane having radial slits, said radial slits spreading open to allow such soft material to pass therethrough upon sufficient pressure being applied to said posterior chamber.

3. A toilet training device in accordance with claim 1, wherein said toilet training device is embodied as an animal having a lower torso and wherein said lower torso has said anterior and posterior chambers.

* * * * *